US007611030B2

(12) United States Patent
Reynolds et al.

(10) Patent No.: US 7,611,030 B2
(45) Date of Patent: Nov. 3, 2009

(54) APPARATUS FOR HANDS-FREE DISPENSING OF A MEASURED QUANTITY OF MATERIAL

(75) Inventors: Aaron R. Reynolds, North Canton, OH (US); Bruce J. Van Deman, Newport Beach, CA (US); Martin O'Toole, Chagrin Falls, OH (US); Paul Waterhouse, Etobicoke (CA)

(73) Assignee: Joseph S. Kanfer, Richfield, OH (US)

( * ) Notice: Subject to any disclaimer, the term of this patent is extended or adjusted under 35 U.S.C. 154(b) by 0 days.

(21) Appl. No.: 10/549,712

(22) PCT Filed: Mar. 16, 2004

(86) PCT No.: PCT/US2004/007893

§ 371 (c)(1),
(2), (4) Date: Jun. 16, 2006

(87) PCT Pub. No.: WO2004/086731

PCT Pub. Date: Oct. 7, 2004

(65) Prior Publication Data

US 2006/0243740 A1 Nov. 2, 2006

Related U.S. Application Data

(60) Provisional application No. 60/456,794, filed on Mar. 21, 2003.

(51) Int. Cl.
*B67B 7/00* (2006.01)

(52) U.S. Cl. ..... 222/1; 222/25; 222/52; 222/63; 222/181.3; 222/333; 222/638; 222/639

(58) Field of Classification Search ..... 222/1, 222/2, 23, 25, 52, 325, 63, 113, 207, 214, 222/333, 181.1, 183, 181.3, 638–639; 33/348.2
See application file for complete search history.

(56) References Cited

U.S. PATENT DOCUMENTS 3,576,277 A 4/1971 Blackman ..... 222/1
3,768,732 A 10/1973 Curtis et al. ..... 239/70

(Continued)

FOREIGN PATENT DOCUMENTS

DE 299 18 082 U1 3/2000

(Continued)

*Primary Examiner*—Frederick C. Nicolas
(74) *Attorney, Agent, or Firm*—Renner Kenner Greive Bobak Taylor & Weber

(57) ABSTRACT

An apparatus for automatically dispensing a fluid includes a container adapted to carry a supply of fluid, and a valve connected to the container, wherein actuation of the valve dispenses the fluid. An apparatus position indicator is associated with the container and an object sensor is positioned near the valve. The object sensor monitors an area below where the valve dispenses when open and upon detection of an object opens the valve. Initial positioning of the apparatus triggers the apparatus position indicator to generate an appropriate signal until the object sensor is properly positioned and permanently secured. A control circuit in cooperation with a hidden switch allows programming of lighting indicators, dispense cycle size, and dispense quantities. The control circuit also provides for overload protection, motor braking and RF shielding. And an anti-vandal feature prevents excessive use of the apparatus.

24 Claims, 11 Drawing Sheets

U.S. PATENT DOCUMENTS

| | | | | | |
|---|---|---|---|---|---|
| 4,274,409 | A | | 6/1981 | Bush | 128/215 |
| 4,274,558 | A | | 6/1981 | Clausen | 222/214 |
| 4,352,444 | A | | 10/1982 | Lewis et al. | 222/309 |
| 4,563,780 | A | | 1/1986 | Pollack | 4/192 |
| 4,606,085 | A | | 8/1986 | Davies | 4/623 |
| 4,673,109 | A | | 6/1987 | Cassia | 222/153 |
| 4,722,372 | A | * | 2/1988 | Hoffman et al. | 141/98 |
| 4,880,149 | A | | 11/1989 | Scholefield et al. | 222/207 |
| 4,896,085 | A | | 1/1990 | Jones | 318/560 |
| 4,921,150 | A | | 5/1990 | Lagergren et al. | 222/639 |
| 4,946,070 | A | | 8/1990 | Albert et al. | 222/52 |
| 4,946,072 | A | | 8/1990 | Albert et al. | 222/105 |
| 4,967,935 | A | | 11/1990 | Celest | 222/63 |
| 4,989,755 | A | | 2/1991 | Shiau | 222/63 |
| 5,014,884 | A | | 5/1991 | Wunsch | 222/333 |
| 5,038,972 | A | | 8/1991 | Muderlak et al. | 222/25 |
| 5,086,526 | A | | 2/1992 | Van Marcke | 4/623 |
| 5,098,666 | A | | 3/1992 | Meinz | 422/111 |
| 5,105,992 | A | * | 4/1992 | Fender et al. | 222/52 |
| 5,217,035 | A | | 6/1993 | Van Marcke | 137/1 |
| 5,243,717 | A | | 9/1993 | Yasuo | 4/623 |
| 5,244,367 | A | | 9/1993 | Aslin | 418/108 |
| 5,249,706 | A | | 10/1993 | Szabo | 222/20 |
| 5,305,916 | A | | 4/1994 | Suzuki et al. | 222/52 |
| 5,329,117 | A | | 7/1994 | Galili et al. | 250/221 |
| 5,344,047 | A | | 9/1994 | Chen | 222/63 |
| 5,385,464 | A | | 1/1995 | Anderson | 425/145 |
| 5,477,984 | A | | 12/1995 | Sayama et al. | 222/52 |
| 5,487,877 | A | | 1/1996 | Choi | 422/300 |
| 5,492,247 | A | | 2/1996 | Shu et al. | 222/63 |
| 5,611,465 | A | | 3/1997 | Lee et al. | 222/214 |
| 5,625,908 | A | | 5/1997 | Shaw | 4/623 |
| 5,761,818 | A | | 6/1998 | Hopkins et al. | 33/366 |
| 5,829,072 | A | | 11/1998 | Hirsch et al. | 4/605 |
| 5,836,482 | A | | 11/1998 | Ophardt et al. | 222/325 |
| 5,855,356 | A | | 1/1999 | Fait | 251/129.04 |
| 5,857,589 | A | | 1/1999 | Cline et al. | 222/1 |
| 5,865,226 | A | | 2/1999 | Sweeney | 141/258 |
| 5,868,311 | A | | 2/1999 | Cretu-Petra | 236/12.12 |
| 5,904,054 | A | | 5/1999 | Lee | 62/347 |
| 5,908,140 | A | | 6/1999 | Muderlak et al. | 222/1 |
| 5,909,830 | A | | 6/1999 | Bates et al. | 222/327 |
| 5,943,712 | A | | 8/1999 | Van Marcke | 4/623 |
| 5,966,753 | A | | 10/1999 | Gauthier et al. | 4/623 |
| 6,036,056 | A | | 3/2000 | Lee et al. | 222/63 |
| 6,039,212 | A | | 3/2000 | Singh | 222/30 |
| 6,142,339 | A | | 11/2000 | Blacker et al. | 222/23 |
| 6,206,238 | B1 | | 3/2001 | Ophardt | 222/1 |
| 6,209,751 | B1 | | 4/2001 | Goodin et al. | 222/52 |
| 6,209,752 | B1 | * | 4/2001 | Mitchell et al. | 222/63 |
| 6,276,565 | B1 | | 8/2001 | Parsons et al. | 222/52 |
| 6,279,777 | B1 | | 8/2001 | Goodin et al. | 222/52 |
| 6,293,428 | B1 | | 9/2001 | Chen | 222/55 |
| 6,343,724 | B1 | | 2/2002 | Ophardt et al. | 222/496 |
| 6,390,329 | B1 | | 5/2002 | Maddox | 222/25 |
| 6,398,513 | B1 | | 6/2002 | Amsler et al. | 417/63 |
| 6,551,739 | B1 | | 4/2003 | Chen | 429/99 |

FOREIGN PATENT DOCUMENTS

| | | | |
|---|---|---|---|
| GB | 2 244 473 | A | 12/1991 |
| GB | 2 256 422 | A | 12/1992 |
| JP | 2000060764 | A | 2/2000 |
| WO | WO 90/12530 | | 11/1990 |

* cited by examiner

A
B

ACTIVATE TIMER
240
ACTUATE AND HOLD BUTTON FOR X, RELEASE
241
DISABLE IR SENSOR
242
219
244
REMOVE / INSTALL BAG
SMART BUTTON ACTUATED OR TIMER EXPIRED ?
NO
245
YES
ENABLE SENSOR
246
247
CALCULATE USAGE BASED ON DOSE CYCLE & DOSE SIZE
RESET REFILL INDICATOR
248
ALERT AT 5% REMAINING
249

APPARATUS FOR HANDS-FREE DISPENSING OF A MEASURED QUANTITY OF MATERIAL

RELATED PATENT APPLICATIONS

This application claims the benefit of U.S. Provisional Application No. 60/456,794 filed on Mar. 21, 2003 and which is incorporated herein by reference.

BACKGROUND OF THE INVENTION

This invention relates, in general, to devices that discharge a measured quantity of cleaning material in response to a physical input. Moreover, this invention relates to improvements in the operation of the dispenser to facilitate ease of use.

DESCRIPTION OF THE PRIOR ART

Dispensers, either wall-mounted or stand-alone, are used to hold a quantity of cleaning material, soap, or other disinfecting material. The dispenser is typically positioned near a source of water which is used with the cleaning material to clean the user's hands. When a user needs a quantity of cleaning material, they actuate a lever or a pump so that a quantity of material is dispensed into their hand. Typically, a predetermined amount is dispensed. This can be adjusted by shortening the pump or stroke so that a lesser amount of material is dispensed.

It will also be appreciated that if not enough material is dispensed, the user may actuate the lever additional times to get the amount needed. Additionally, if the container of material is empty, the user will actuate the lever additional times and exert excessive force in an attempt to "squeeze" out the last bits of cleaning material. This applies unnecessary stresses on the actuating lever and associated linkage and, after a period of time, can cause the dispenser to break.

There are various apparatuses that detect the presence of hands or other objects which need to be cleaned and initiate dispensing of water, but not in particular amounts. Examples of such devices are disclosed in the patents to: Yasuo, U.S. Pat. No. 5,243,717; Blackmon, U.S. Pat. No. 3,576,277; Davies, U.S. Pat. No. 4,606,085; Abert et al., U.S. Pat. No. 4,946,070; Van Marcke, U.S. Pat. No. 5,086,526; Van Marcke, U.S. Pat. No. 5,217,035; Shaw, U.S. Pat. No. 5,625,908; Hirsch et al., U.S. Pat. No. 5,829,072; and Van Marcke, U.S. Pat. No. 5,943,712. It is also known to provide devices with sensors which detect the hand position as it relates to the faucet and adjusts the temperature of the water accordingly. This is generally taught in the patents to Fait, U.S. Pat. No. 5,855,356; and the patent to Cretu-Petra, U.S. Pat. No. 5,868,311. It is also known to detect the presence of a device and initiate a timing sequence for dispensing materials when multiple users are present, as disclosed in the patent to Gauthier et al., U.S. Pat. No. 5,966,753.

Various computer-type control devices may be used in the dispensing of materials such as shown in the patent to Pollack, U.S. Pat. No. 4,563,780, which discloses a programmable device used by various members of the family to store their water temperature preferences when washing their hands.

Although the above described dispensing devices are effective in their stated purpose, it is believed that the mechanisms used to dispense a known quantity of material still exert undue forces on the dispensing mechanism which causes the devices to prematurely wear. Moreover, users who are unfamiliar with the dispensing device may grab or mis-handle the dispensing device looking for a dispensing lever when such does not need to be done. It has been found that most, if not all, automatic dispensing devices do not provide an intuitive indication of where the users are to place their hands or the object to be cleaned so that a dispensed quantity of material may be deposited thereon.

A clear improvement in the aforementioned prior art is disclosed in U.S. Pat. No. 6,390,329. This patent discloses a hands-free dispensing device which utilizes a unique gearing mechanism to dispense a measured quantity of fluid material. In particular, the disclosed device utilizes an infrared object sensor which detects the presence of an object. Upon detection of this object a motorized pump actuator mechanism converts a motor shaft's rotatable motion into a linear motion which actuates a dispense mechanism which dispenses a predetermined amount of fluid in a location proximal to the detection zone of the object sensor. Although this device is a clear improvement in the art, it has been found lacking in several regards. First, proper installation of such a device is problematic inasmuch as the infrared sensor, if not properly positioned, will inadvertently actuate the dispensing mechanism and fluid material will accumulate in undesired locations. Additionally, the motorized mechanism does not positively stop at the end of a cycle and as such the gearing contained within the pump actuator mechanism may jam and/or cause the gearing to misalign. Additionally, it has been found that electrical interference between the various components controlling the dispenser and the object sensor may result in misactivation of the pumping mechanism. The device is also lacking in features which facilitate ease of use.

Therefore, it has become apparent that it is desirable to have an apparatus for dispensing a measured quantity of material which provides a positive braking mechanism to ensure proper operation of the dispenser. It is also desirable for this apparatus to be provided with a locating feature to properly install the device so as to preclude inadvertent actuations of the dispensing mechanism. And it is also desirable for the apparatus to be provided with various programming modes to accommodate different types of fluid material carried by refill containers and their associated dispensing mechanisms and also to accommodate for the allowance of multiple dosages to be dispensed in the appropriate environment. It is also desirable for the device to automatically turn-on after proper installation and to automatically shut down if excessive use is detected.

SUMMARY OF THE INVENTION

It has been found, therefore, that an apparatus for hands-free dispensing of measured quantities of fluid material can be provided which improves operation of the known hands-free fluid dispensing devices. In particular, initial positioning of the apparatus is facilitated by use of the object sensor such that prior to permanent installation of the apparatus and loading of the fluid material, the sensor indicates that the device is properly positioned for use. In other words, the infrared sensor sends out a test signal and if the apparatus is temporarily positioned in an undesirable location, indicia will turn off to indicate to the installer that this position is not appropriate. Accordingly, the installer will move the device to another position for location testing. If the lights turn on at this time, then the installer knows that this is an appropriate position for the infrared sensor and that installation of the device is proper in the position selected. Upon completion of the installation of the device the apparatus is loaded with a container of fluid material connected to a dispensing mechanism which deposits a measured quantity of material when the presence of an object is detected and without the user having to actuate a push bar or lever.

In the initial setup procedure of the dispensing apparatus, the installer may select among at least three different program modes. In the first program mode the user may activate or deactivate a plurality of LEDs or lighting indicia which instruct the end-user of the device as to the proper positioning of their hand or other object to be in a position to receive a dispensed quantity of fluid material. Accordingly, the installer may select whether to provide this lighting indicia or not. In a second program mode, the end-user may select a dosage size. For example, the installer may select one, two or three cycles of operation depending upon the nature of the installed environment. In a final programming mode, the installer may select the dispenser size for the type of fluid which is to be dispensed. It will be appreciated that the amount of fluid dispensed for lotions is different than the amount of fluid dispensed for soaps and the like. Accordingly, after conclusion of these various modes and installation of the designated fluid, the object sensor is enabled and an associated processor will calculate the amount of usage anticipated for that particular fluid dispensing device. Accordingly, upon reaching a predetermined use level, typically about 95%, an alert signal is generated to indicate to the user that the fluid material needs to be replaced. The calculated amount of usage may be reset upon replacement of the fluid container.

Other operational features of the apparatus include an auto-on sequence and an anti-vandal sequence. The auto-on sequence automatically turns the apparatus on after installation of fresh batteries and passage of a certain period of time. Or, the apparatus automatically turns on a period of time after the apparatus had been turned off. The anti-vandal feature automatically turns the apparatus off if the dispense mechanism is actuated excessively in a short period of time.

It will be appreciated that the apparatus may be provided with additional circuitry features to facilitate its operation. Accordingly, a control circuit with an overload circuit may be provided such that any detection of gear jamming or other malfunctions of the gearing mechanism will generate a signal that is received by a processor to stop operation of a motor that actuates a dispense mechanism and precludes any further damage to the apparatus. Yet another feature that may be provided by the control circuit of the fluid dispenser is a braking circuit which automatically turns the motor off at the end of a dispense cycle to prevent its coasting so as to ensure the proper positioning of the gears and related mechanisms. Still yet another feature of the apparatus is the separation of various components within the control circuit such that the infrared sensor which is used to detect the object is isolated from other circuitry components. Accordingly, this feature substantially minimizes false activations of the dispense mechanism so as to reduce unwanted usage.

Accordingly, use and operation of an apparatus for hands-free dispensing of a measured quantity of material, as described above, becomes the principal object of this invention with other objects thereof becoming more apparent upon a reading of the following brief specification considered and interpreted in view of the accompanying drawings.

BRIEF DESCRIPTION OF THE PREFERRED EMBODIMENTS

Figure 1:
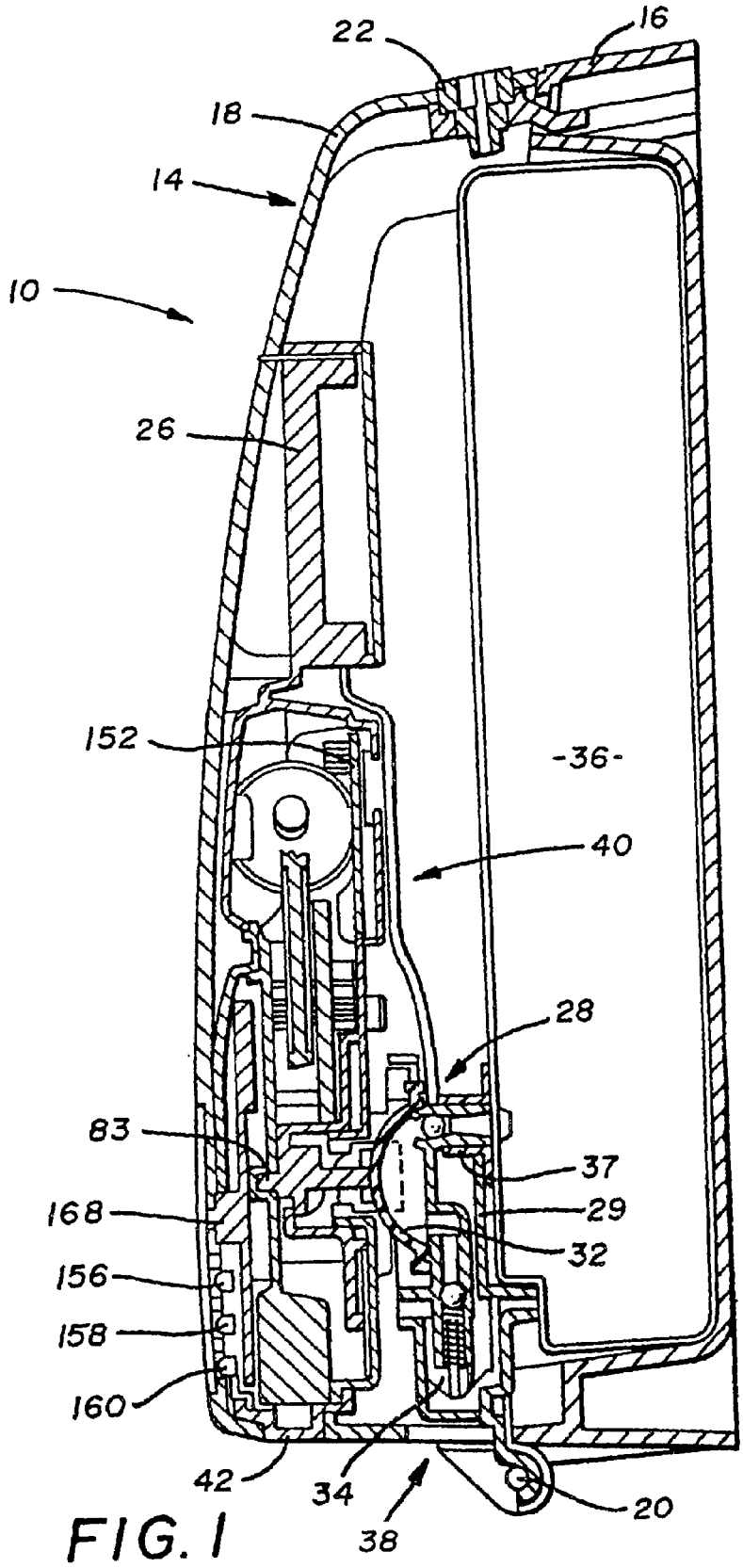
FIG. 1 is a side elevational cross-sectional diagram of the apparatus.
Figure 2:
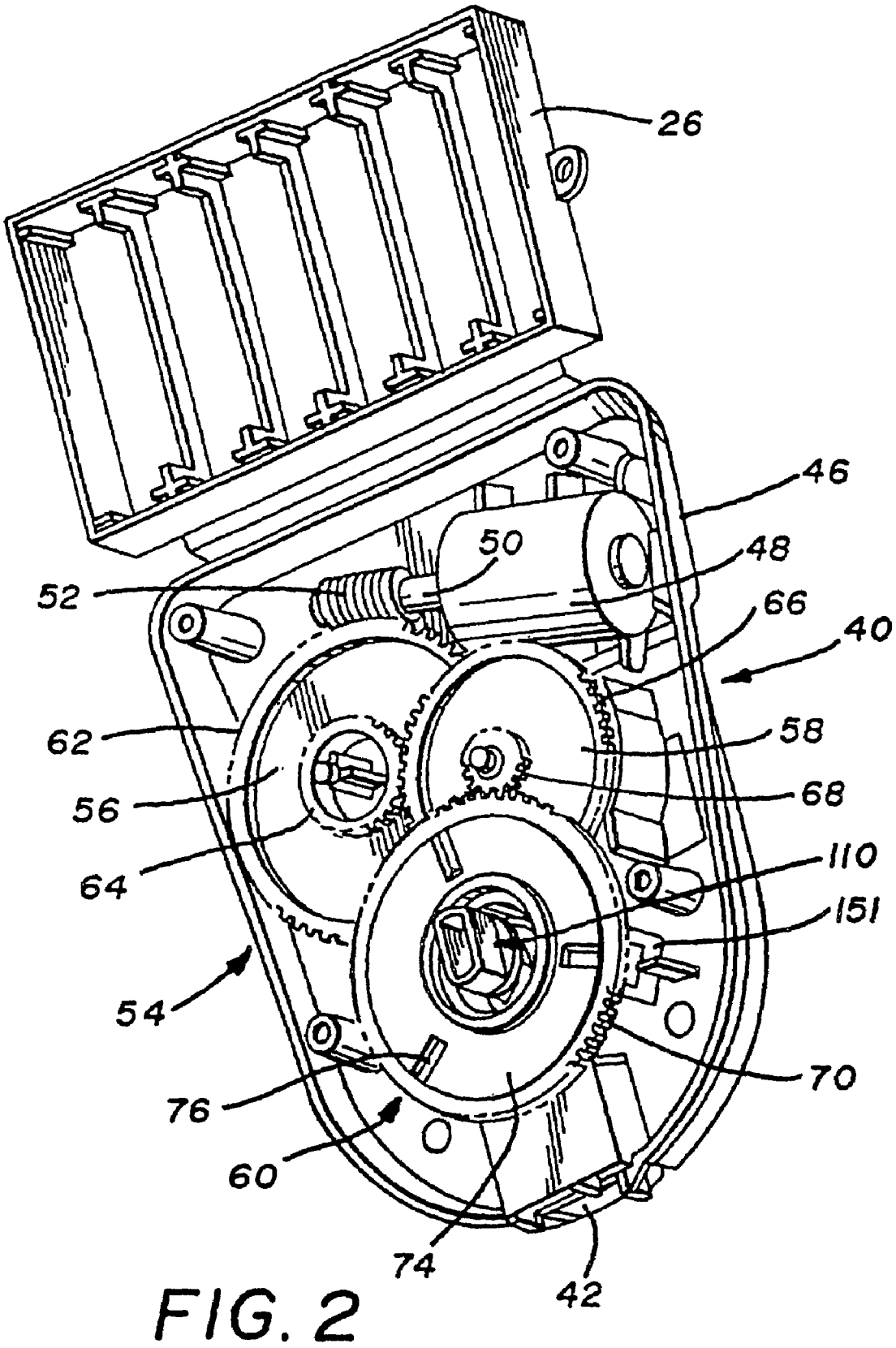
FIG. 2 is a front perspective view of a pump actuator mechanism employed in the apparatus.
Figure 3:
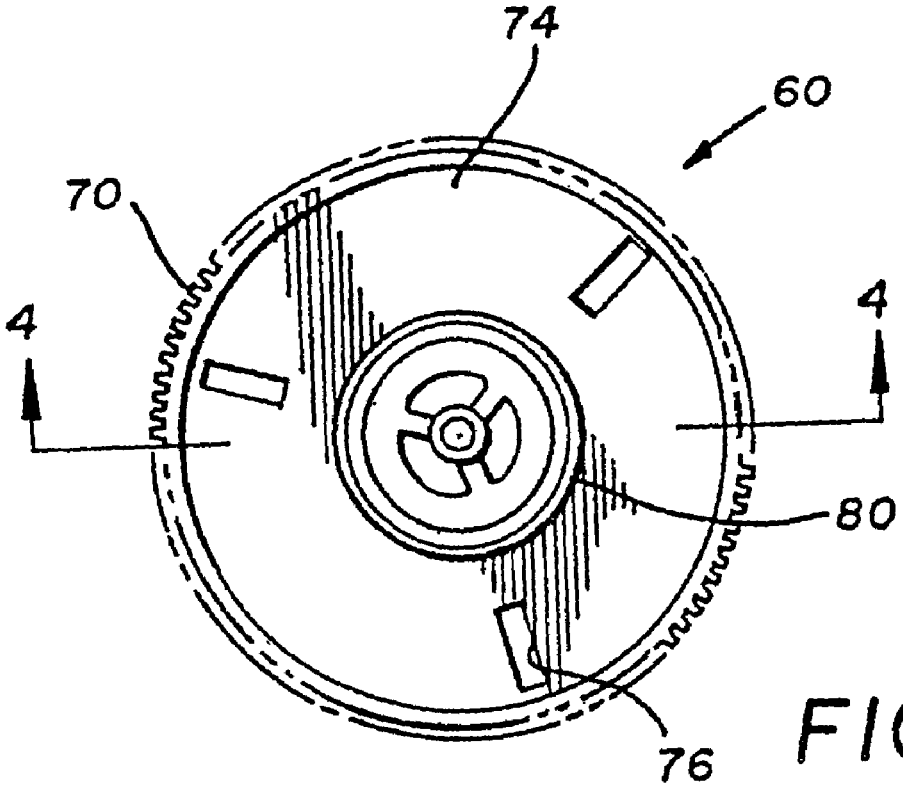
FIG. 3 is a top plan view of a spur gear employed in the pump actuator mechanism.
Figure 4:
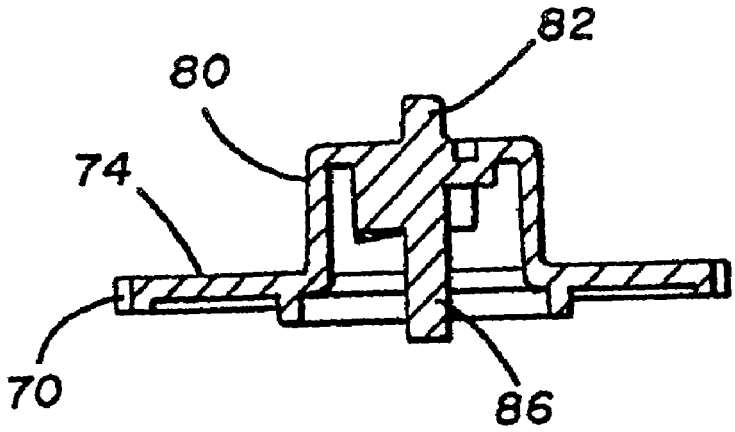
FIG. 4 is a cross-sectional view, taken substantially along line 4-4 of FIG. 3, of the spur gear.
Figure 5:
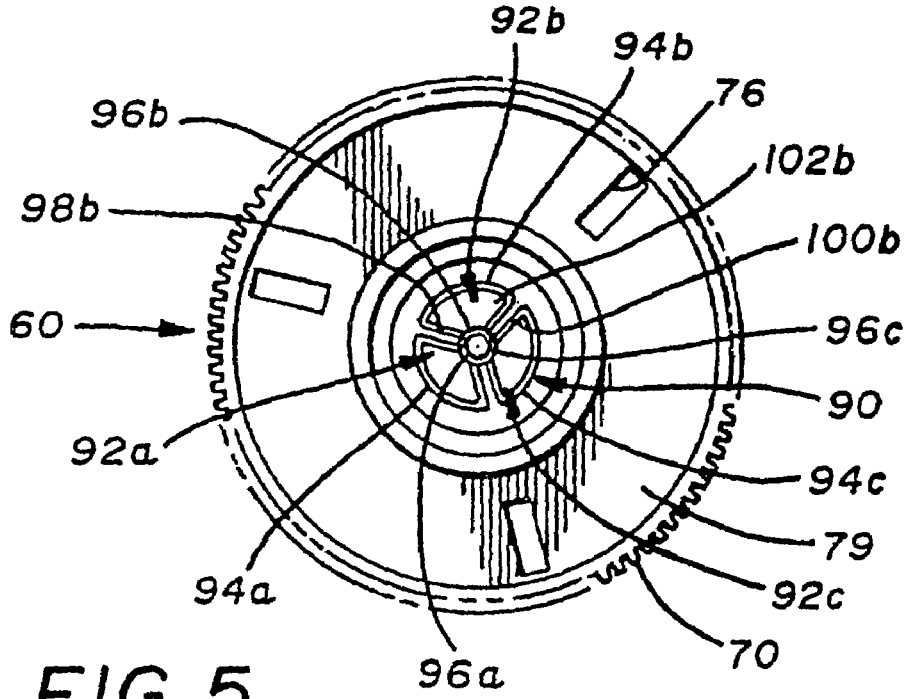
FIG. 5 is a bottom plan view of the spur gear employed in the pump actuator mechanism.
Figure 6:
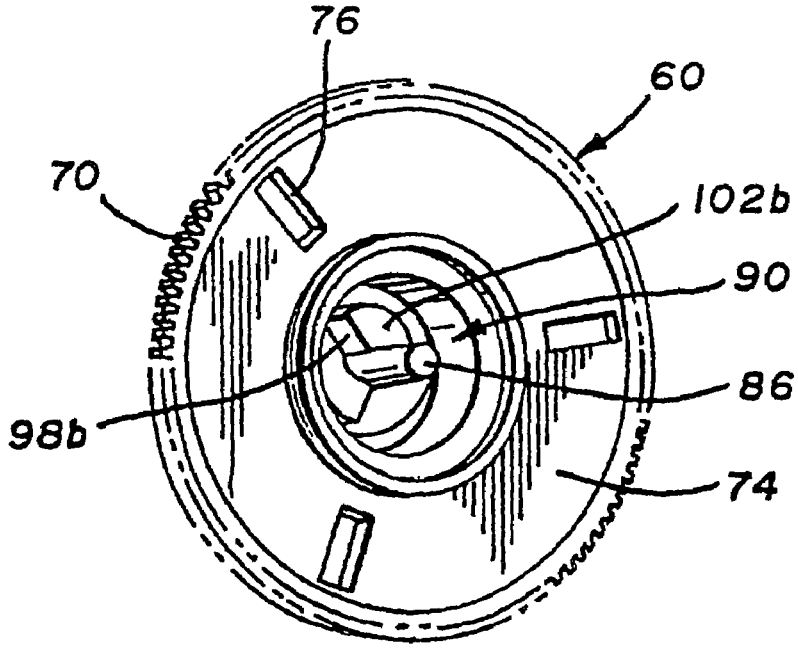
FIG. 6 is a rear perspective view of the spur gear.

FIG. 1 depicts an apparatus or dispenser, generally designated by the numeral 10, for dispensing a measured quantity of material as a result of hands-free actuation. The dispenser 10, which may be a wall-mounted or a stand-alone device, includes a housing 14 having a back shell 16 mateable with a front shell 18. In the preferred embodiment, the back shell 16 and the front shell 18 are connected by a hinge 20 at an underside of the dispenser 10. If desired, the hinge mechanism may be placed on either side of the dispenser 10 or at its top. A key latch 22 is provided at the side opposite of the hinge 20 so as to hold the front shell 18 in a mated position with the back shell 16. This encloses the device and precludes its access by unauthorized personnel. Although a key latch is shown, it will be appreciated that other mechanisms for latching the two shells 16 and 18 to one another may be employed. The shells 16 and 18 are preferably manufactured of a rigid plastic material which maintains its appearance, is easy to manufacture, and easily withstands day-to-day use.

A battery compartment, designated generally by the numeral 26, is carried by an interior surface of the housing 14. The battery compartment 26, in the preferred embodiment, carries eight AA batteries. The batteries are employed to operate various features of the dispenser as will become apparent from the discussion below. Of course, other battery sizes and quantities could be employed. Alternatively, an AC power source or the like could be used.

A dispense mechanism, which is generally designated by the numeral 28, is carried by a plate 29, The hinge 20 carries the plate 29 such that when the front shell 18 is opened, the dispense mechanism 28 remains supported by the plate 29. The dispense mechanism 28 may be one commonly available in the art or, in the preferred embodiment, is like the one disclosed in U.S. patent application Ser. No. 09/397,314 filed on Sep. 16, 1999, and which is assigned to the Assignee of the present invention and which is incorporated herein by reference. The dispense mechanism 28 incorporates a pump dome valve 32 which, when pressed, dispenses a measured quantity of fluid material carried by a fluid material container 36. Of course, other valve mechanisms could be used to dispense fluid. The dispense mechanism 28 is coupled to the container 36 via a connector 37. The container 36 is a replaceable unit as is well known in the art. When the pump dome valve 32 is actuated, the material is dispensed via a nozzle 34 through an opening 38 in a bottom portion of the front shell 18 into the user's hand, as will be described in detail below. The fluid material container 36 may contain soap, disinfectant, or other fluid material that is dispensable through the pump mechanism 28. Ideally, the container 36 will carry 1,000 mL of fluid material product. The dispense mechanism 28 typically deposits or dispenses 1.5 mL of product per cycle. Of course, the container 36 may be different sizes. And the dispense mechanism may dispense different quantities.

A pump actuator mechanism, which is generally shown in FIG. 1 and which is shown in detail in FIGS. 2-10, and generally designated by the numeral 40, includes an infrared sensor 42. The infrared sensor is positioned at an area near the opening 38 of where the dispense mechanism 30 deposits the material. The infrared sensor, which includes an emitter and receiver, detects the presence of an object, such as a user's hand or other object to be cleaned, and cycles the pump actuator mechanism 40 to dispense a measured quantity of fluid material. Of course, other commercially available sensors which detect the presence of an object, without direct physical contact, and generate a corresponding actuation signal may be employed in the present invention.

The pump actuator mechanism 40 is carried in an assembly housing 46 which is replaceably mounted to the interior of the front shell 18 such that when the front shell is hingedly opened, the assembly housing 46 moves in a like manner. Carried in the assembly housing 46 is a motor 48 which is powered by the batteries carried in the battery compartment 26. The motor has a rotatable shaft 50 extending therefrom with a worm gear 52 at one end. The worm gear 52 operatively drives a differential gear assembly 54 in a manner well known in the art. Briefly, the purpose of the differential gear assembly is to significantly reduce the speed of the motor output so that the dispensing of the material can be easily controlled. Alternatives for imparting a force to the differential gear assembly could be provided by a piston or solenoid configuration.

The differential gear assembly 54 converts the initial high-speed rotation of the motor shaft to a more manageable rotational speed that can then be converted into a linear motion that repeatably engages the dispense mechanism 30. The differential gear assembly 54 includes three spur gears 56, 58, and 60. The worm gear 52 contacts a plurality of outer teeth 62 of the first spur gear 56. The spur gear 56 also includes a plurality of inner teeth 64 that mesh with a plurality of outer teeth 66 extending from the periphery of the second spur gear 58. In a like manner, a plurality of inner teeth 68 of the spur gear 58 engage a plurality of outer teeth 70 of the spur gear 60. As those skilled in the art will appreciate the rotational velocity of the spur gear 60 is significantly reduced by the interconnecting gears 56 and 58.

As best seen in FIGS. 1 and 3-6, the spur gear 60 includes a plate 74 with radially disposed slots 76 extending therethrough and positioned in about 1200 increments. It will be appreciated that the number of slots and their position can be varied as needed. Extending from the plate 74 in one direction is a hub 80 from which further extends a nub 82. The nub 82 is received in an indentation 83 in one side of the assembly housing 46 so as to rotatably receive and align the gear 60. This assists in the uniform and efficient rotation of the gear 60 which, in turn, ensures the effective operation of the mechanism 40.

An axial stem 86 may concentrically extend from a bottom surface of the hub 80 toward the plate 74. Disposed between an interior wall of the hub 80 and the axial stem 86 is a hub cam, generally designated by the numeral 90. The hub cam 90 is concentrically disposed around the stem 86.

The hub cam 90 includes a plurality of hub ramps 92, wherein each hub ramp is provided with an alphabetic suffix designation (a, b, or c in the drawings). Although three hub ramps 92 are shown, it will be appreciated by those skilled in the art that one, two, or more ramps may be provided, depending upon the desired pumping action. The hub ramps 92 are essentially identical in construction and their various features are also provided with a corresponding alphabetic designation. Each hub ramp 92 includes an outer wall 94 which is concentrically adjacent the interior wall of the hub 80, and an inner wall 96 which is concentrically adjacent the axial stem 86. The outer walls may be integral with the interior hub wall, or they may be spaced apart from the wall, as shown. Likewise, the inner walls may be spaced apart from the axial stem, or they may be integral, as shown. The outer wall 94 and the inner wall 96 are connected at one end by a trailing wall 98 and at the opposite end by a leading wall 100. Each of these walls—94, 96, 98, and 100—are connected by a cam surface 102 which angularly extends from the trailing wall 98 to the leading wall 100. The leading wall 100 is of minimal height at the bottom of the hub. The cam surface 102 rises up from the leading wall 100 and extends to the trailing wall 98. The top of the trailing is at about a mid-point position between the bottom of the hub 80 and the plate 74.

Figure 7:
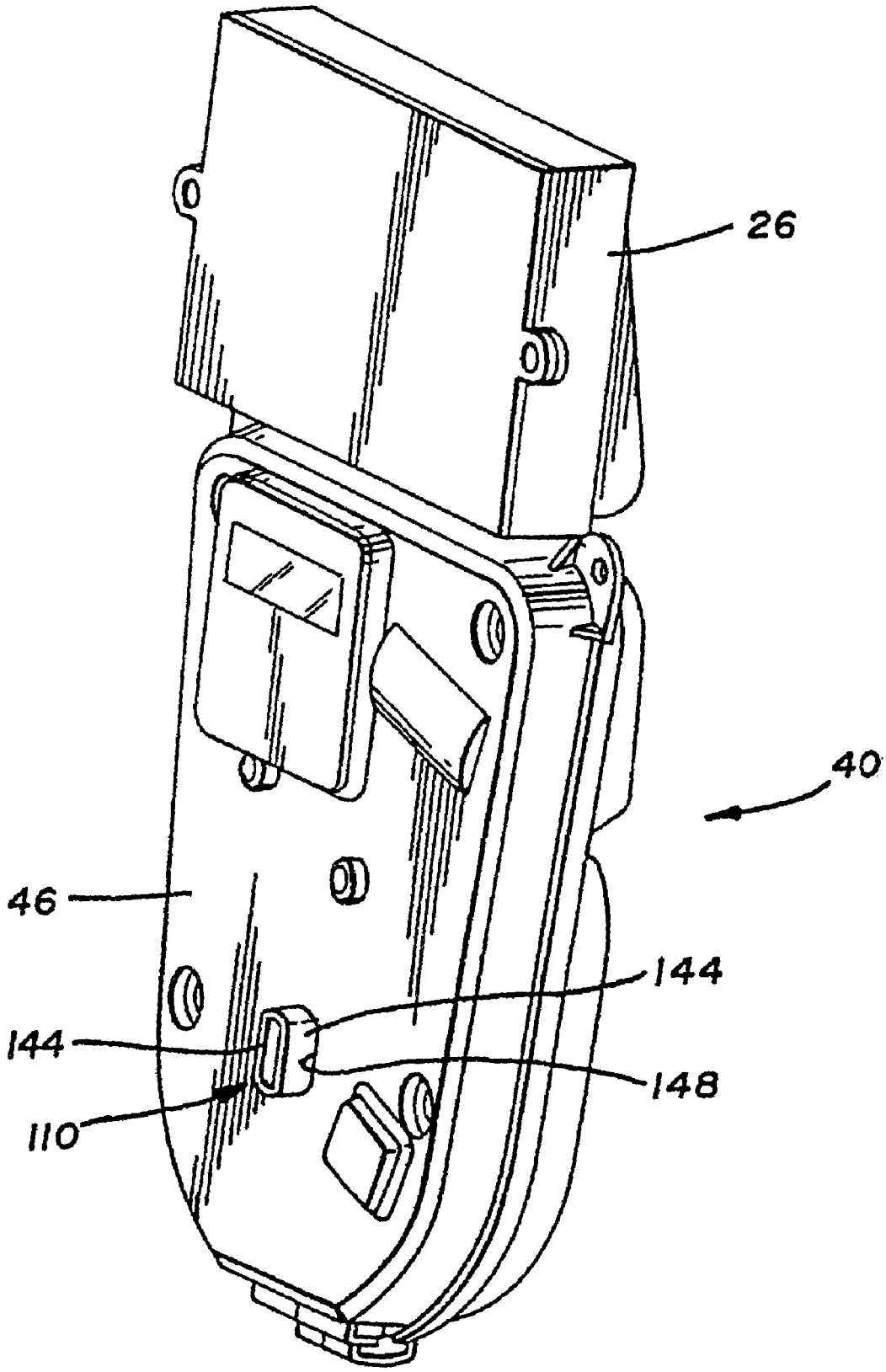
FIG. 7 is a rear perspective view of the pump actuator mechanism.

In order to convert the rotational motion of the motor shaft 50, an actuator gear, generally designated by the numeral 110, is slidably received within the hub 80. The actuator gear 110 is also slidably captured within the housing 46, as seen in FIG. 7. Accordingly, the actuator gear 110 is moveable into and out from the assembly housing to actuate the dispense mechanism 30.

Figure 8:
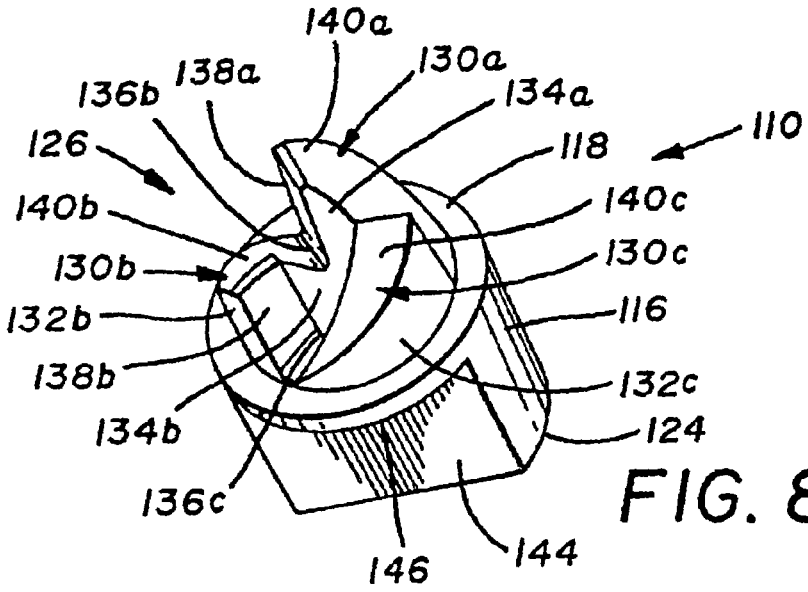
FIG. 8 is a front perspective view of an actuator gear employed in the pump actuator mechanism.
Figure 9:
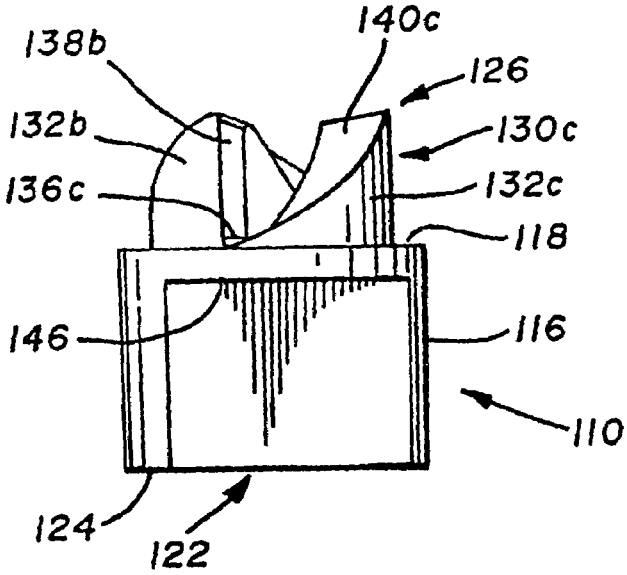
FIG. 9 is a side elevational view of the actuator gear.
Figure 10:
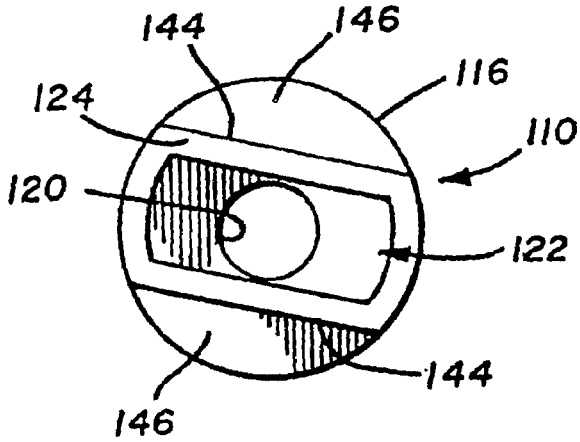
FIG. 10 is a bottom elevational view of the actuator gear.

The actuator gear 110, as best seen in FIGS. 8-10, includes a sleeve 116 which has a partially enclosed end 118 with a hole 120 therethrough. The hole 120 slidably fits over the axial stem 86 for alignment and positioning purposes. Opposite the partially closed end, the sleeve has a rim 124 that forms an open end 122. Extending outwardly from the partially closed end 118 is a sleeve cam 126 which coacts with the hub cam 90. The sleeve cam 126 includes a plurality of sleeve ramps 130 which have alphabetic suffix designations for each of the ramps provided. The number of ramps provided correspond to the number of ramps provided by the hub cam 90. Each sleeve ramp 130 includes an outer wall 132 and an inner wall 134. The outer and inner wall are joined by a leading wall 136 and a trailing wall 138. Each ramp 130 provides a cam surface 140 that interconnects the outer, inner, leading, and trailing walls.

Initially, the actuator gear 110 is primarily received within the hub 80. Accordingly, the trailing walls 98 align with the leading walls 136 in a resting position. When the sensor 42 detects an object and initiates the pump actuator mechanism 40, the gear 60 rotates and the camming action upon the actuator gear 110 is initiated. As this happens, the rim 124 moves axially outwardly from the plate 74 and compresses the dome valve 32. This continues until the trailing walls 98 are aligned with the trailing walls 138. At which time, due to the resiliency of the pump dome valve 32, the actuator gear 110 falls back into the hub and the rim 124 returns to its original position. Alternatively, instead of relying on the resiliency of the dome, the actuator gear could be returned to its initial position by use of additional gearing or by spring biasing. In any event, reciprocating motion of the actuator gear 110 cycles the dispense mechanism 30.

In order to maintain alignment and to hold the actuator gear 110 within the housing, the sleeve 116 includes a pair of opposed flats 144. Each flat 144 extends from the rim 122 to a stop plate 146. The housing 46 has a rounded-slot 148 that slidably receives a portion of the actuator gear 110. In particular, the flats 144 extend through the slot 148, while the interior of the housing 46 bears against the stop plates 146 when the gear 110 is fully extended. This precludes the actuator gear 110 from falling out of the housing and ensures that the actuator gear 110 remains in place and is returnable to a starting position to initiate additional operating cycles.

A sensor 151 is provided in the assembly housing 46 and is alignable with the slots 76 and the plate 74. Accordingly, as the sensor 151 detects the passing of the slot 76, the sensor instructs the motor to stop rotation. This ensures that only one actuating of the dispensing mechanism occurs for each detection of a hand or object to be cleaned underneath the sensor 42. Of course, the sensor 151 could be situated or programmed to allow for passage of two or more slots 76 to allow for multiple cycling of the dispense mechanism 30. The sensor 151 could be an infrared type that detects interruption of an infrared beam. A magnetic proximity switch or a monitored timer could also be used to detect gear position.

Figure 11:
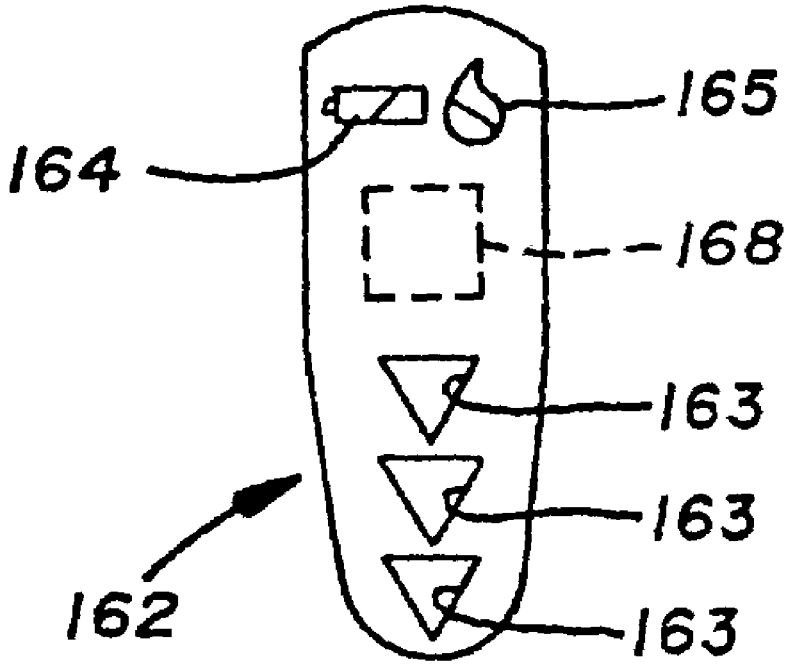
FIG. 11 is an elevational view of a front panel of the apparatus.
Figure 12:
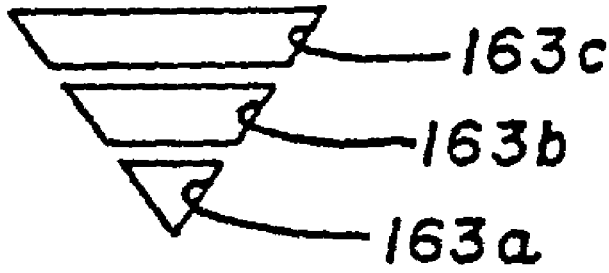
FIG. 12 is an elevational view of alternative indicia configuration of the front panel.

The pump actuator mechanism 40 includes a control circuit 152 which utilizes the power generated from the batteries to illuminate a series of light emitting diodes 156, 158, and 160 that are viewable through a panel 162 on the front shell 16. The panel, as seen in FIG. 11, is provided with indicia adjacent the LEDs to assist the user. In the preferred embodiment, the panel provides downwardly pointing triangles 163. These LEDs may be any color but are preferably green in color and may be sequenced to illuminate in a manner which indicates the direction in which the user must place their hand to activate the sensor 42. For example, the top LED 156 is illuminated first and then followed in rapid succession by LEDs 158 and 160. After a predetermined delay, the lighting sequence starts over. Moreover, other shapes or combinations of dissimilar shapes could be used in place of the triangles 163. See, for example, FIG. 12. Although three LEDs are shown, it will be appreciated that two or more LEDs may be provided. Also provided in a viewable area of the front shell is a low battery indicia LED 164 which, when illuminated, indicates that the batteries are running low. A low fluid indicia LED 165 is illuminated when a calculation performed by the control circuit 152 determines that the container 36 needs to be replaced. The LEDs 164 and 165 may be any color, but preferably they are red and yellow, respectively.

Also provided in an area near the LEDs is a "smart" or hidden switch 168. Location of this switch is typically only known by housekeeping personnel and is depressed so as to disable the sensor 42 for a predetermined time period, e.g., one minute. This allows the housekeeping personnel to clean underneath the dispenser without activating the dispensing mechanism during that time. Opening of the front shell 18 also removes the coupling between the pump actuator mechanism 40 and the dispense mechanism 28. In this position, actuation of the sensor 42 will not cause inadvertent dispensing of material.

Other features which may be added to the dispenser are timing mechanisms which emit an audible tone when the dispenser is cycled. A 20-second timer then emits another tone to indicate that a washing event may be completed. Also, the dispenser may be provided with an AC adapter so as to eliminate the need for battery power. Yet another feature of the present invention is that a malfunctioning pump actuator mechanism or dispense mechanism may be easily replaced by opening the front shell and removing the appropriate fasteners and then installing a new unit.

Figure 13:
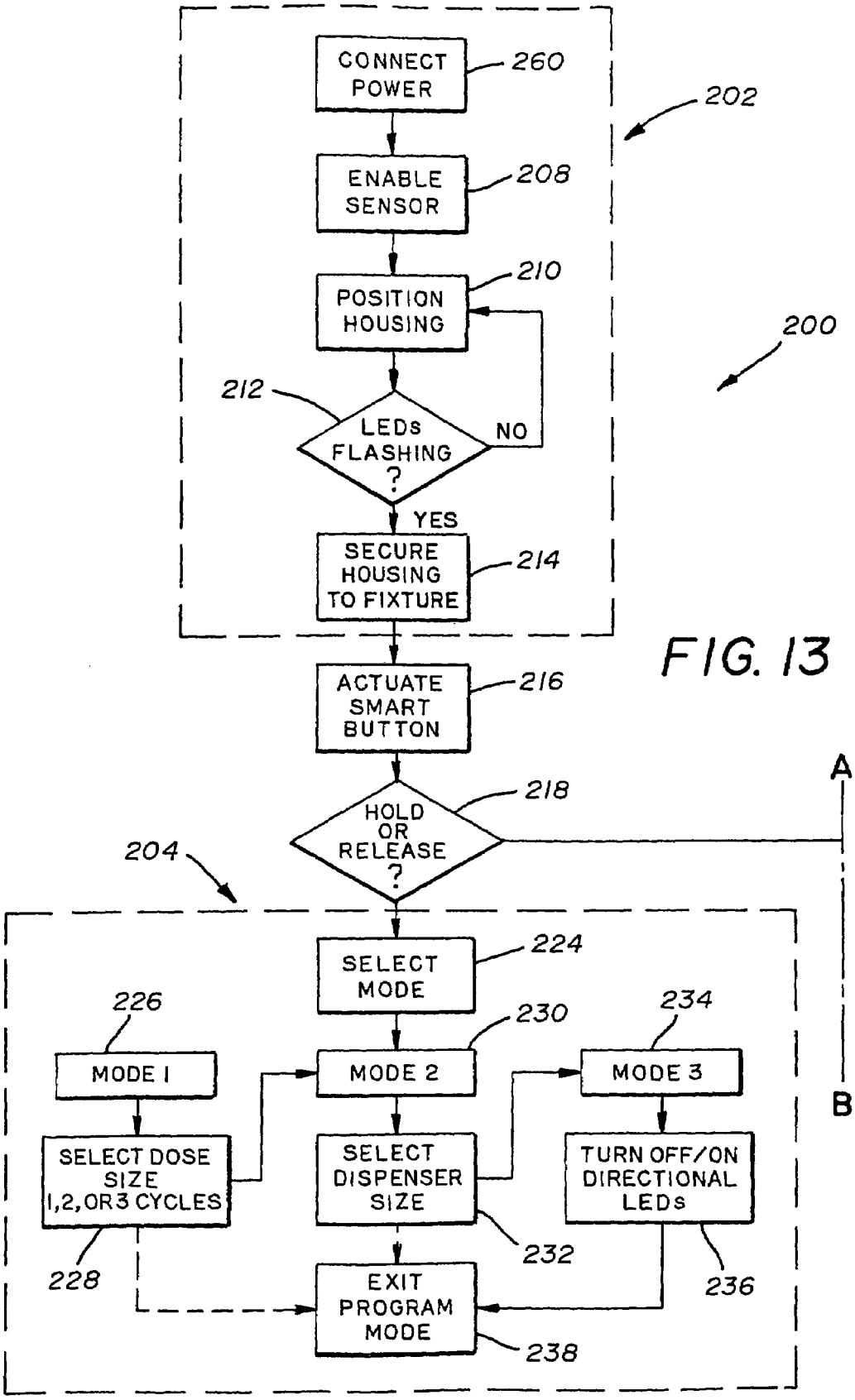
FIGS. 13 and 13A are an operational flow chart for the set up and programming mode steps utilized by the apparatus according to the present invention.
Figure 13A:
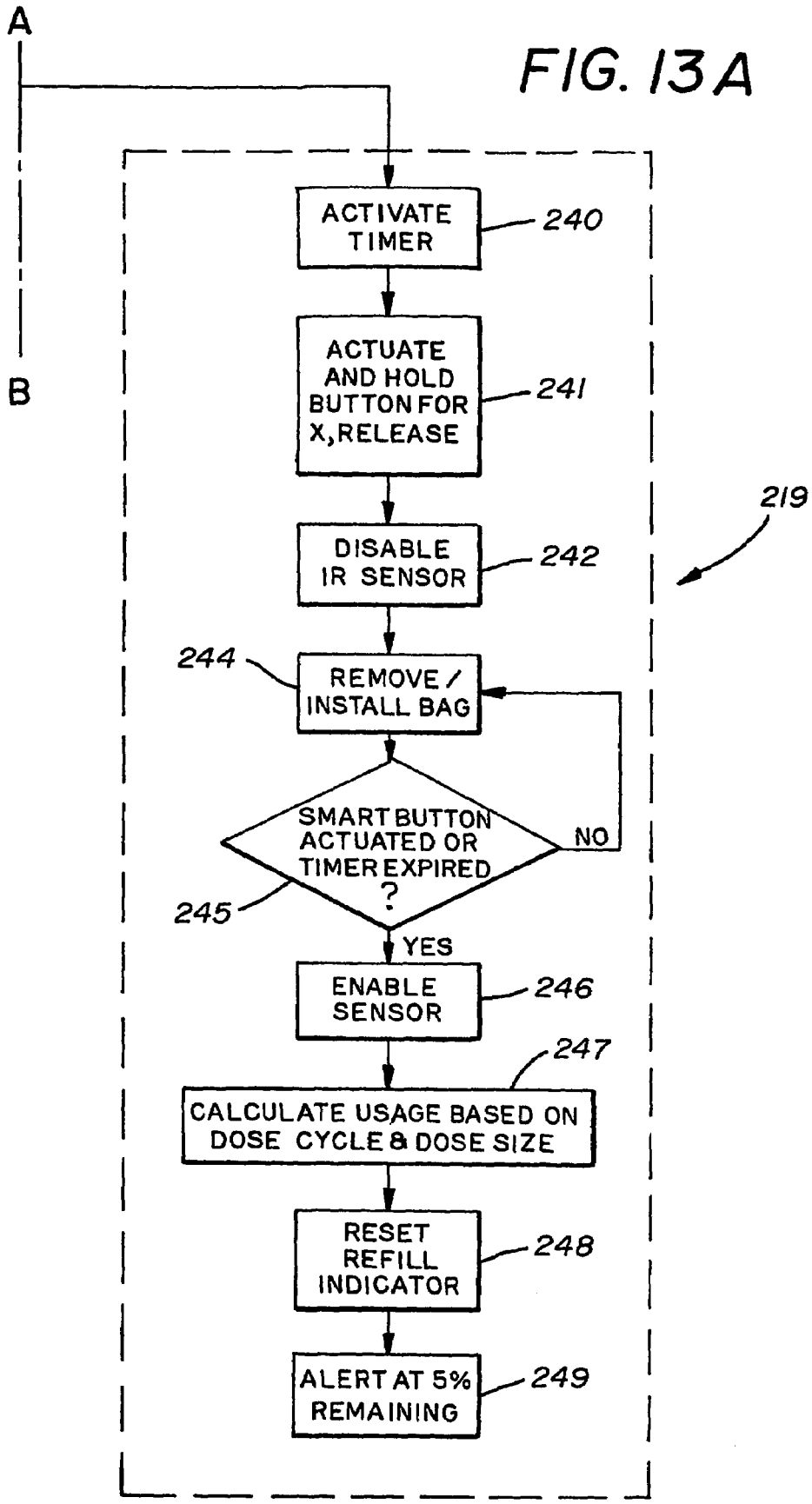

Referring now to FIGS. 13 and 13A, installation, programming and use of the dispenser 10 is described in detail. It will be appreciated that an operational procedure 200 includes an installation procedure designated generally by the numeral 202, a program procedure generally indicated by the numeral 204, and a refill replacement procedure generally indicated by the numeral 219. Implementation of the procedures 202, 204, and 219 are facilitated by operation of the control circuit 152, the components of which will be described in detail below. In any event, the installation procedure 202 starts at step 206 wherein the installer will connect an appropriate power source to the control circuit 152 at step 206. This may include the installation of batteries into the battery compartment 26 or connection of a power supply in the event batteries are not utilized. At step 208 the sensor 42 is automatically enabled and functions as previously described and the LEDs 156-160, or other signaling mechanism begin to flash repeatedly. Of course other indicators of proper positioning could be employed such as auditory signals, vibrations, indicia on a liquid crystal display, utilizing a different sequencing of lights to name just a few.

At step 210, prior to loading a container of fluid, the installer positions the housing 14 in a preferred location. Typically this location will be near a sink if the dispenser is used to dispense soap. However, the dispenser may be positioned elsewhere in convenient locations such as in a restaurant, hospital or other facility where sanitizing lotions are to be dispensed or, in the alternative, where moisturizing lotions are to be dispensed. In any event, the positioning of the housing 210 is critical inasmuch as the sensor needs to be positioned in an area where it is not inadvertently triggered. If such an event were to occur, the fluid contained within the dispenser would be dispensed without anyone to collect the dispensed material. Accordingly, if the infrared sensor falsely detects the presence of an object when in fact no object is present its material may be automatically dispensed resulting in waste and a mess. When the infrared sensor is placed in a preliminary position and if the infrared sensor detects an object when in fact the installer knows that object is not a proper object to actuate the dispenser, then the plurality of LEDs, such as the LEDs 156, 158 and 160, will stop flashing repeatedly at step 212. If this occurs, the installer will then know to re-position the housing at step 210. This repositioning step is repeated until the LEDs flash repeatedly. When the LEDs flash repeatedly the sensor is in a position to detect an object that is specifically placed in the zone of receiving a dispensed fluid. At step 214, the installer permanently secures the housing in a position where the LEDs are flashing.

Various operational features may be implemented upon installation of the dispensing device. In order to implement these operational features, the smart or hidden button 168 is actuated at step 216. The control circuit then monitors the smart button to determine if it is held or released at step 218. If the button is held, then the process continues with the program procedure 204. If the button is released, then the process continues with the replacement procedure designated generally by step 219.

In the program procedure 204, at step 224 the installer may select from three program modes. These modes are preferably selected by pushing and holding the button on. But the control circuit could be configured so that other button inputs could be used to enter into the three program modes directly.

In a first mode, at step 226, the installer is allowed to select dosage sizes of one, two or three cycles at step 228. This is done by repeatedly pressing the smart button once until the number of cycles (1, 2 or 3) is selected. An indication of the number of cycles may be provided by lighting the LEDs in a predetermined pattern. This could also be done by displaying a number indicia or by a verbal annunciation generated by a speaker connected to the control circuit. This allows the installer to properly size the amount of fluid to be dispensed depending upon the location of the unit. For example, a preschool installation would only require a one cycle dispensing to take place. In contrast, a garage or factory setting would typically require a three cycle dispensing operation to take place in view of the large amount of soap typically required to clean hands in such an environment. An in-between two cycle selection may also be provided. Although only three cycles of operation are allowed for selection in the preferred embodiment it will be appreciated that any number of dispensing cycles may be programmed. Upon completion of step 228 the process may continue to the exit program mode at step 238, but it is preferred that the program sequence continue by pushing and holding the smart button again so as to enter mode 2.

If mode 2 is selected, at step 230, the installer is allowed to select the dispenser size at step 232. The dispenser size 232 is associated with the type of material to be installed in the dispensing unit. Typically 1.0 ml of fluid is dispensed if the fluid is a moisturizer. Alternatively, 1.25 ml may be dispensed if the fluid is a sanitizer. And, 1.5 ml of fluid is dispensed if the fluid is a soap. The dispenser size is selected by repeatedly pressing and releasing the smart button. Upon selection of the dispenser size the program may continue to the exit program mode at step 238, but it is preferred the program sequence continue by pushing and holding the smart button so as to enter mode 3.

In mode 3, performed at step 234, the installer will select whether to turn on or off the directional LEDs at step 236. This is done by repeatedly pressing the smart button once until the illumination mode is selected—flashing drops or not—. As with the other modes, visual or audible communications could be used to confirm the lighting mode. The directional LEDs are utilized to indicate to the end-user where to place their hand or other object which is to receive the dispensed fluid. Accordingly, if it is desired to extend battery life by not illuminating the directional LEDs, they may be turned off. Or, if the end-user desires to have the LEDs turned on, for example, in a preschool environment to ensure that the dispensing device is properly used, then the LEDs may be turned on. Upon completion of step 236, the program proceeds to the exit program step at step 238.

If at step 218 the installer selects the replacement sequence 219, the control circuit proceeds to step 240. At step 240, the control circuit is momentarily placed in the off condition when the button is released and a timer is activated. The timer is set for a predetermined period of time such as five minutes although other time periods could be utilized. Next, at step 241, the control circuit awaits actuation and holding of the button for a predetermined period of time such as five seconds, which could be longer or shorter, and then awaits the release of the smart button. Once the button is released, the process proceeds to step 242 and the infrared sensor is disabled. At step 244 the installer is allowed to open the container and remove the depleted refill container if one is needed to be emptied and has the appropriate time to install a new refill container. The housing is then closed and then at step 245 the controller awaits actuation of the smart button or elapsing of the timer. If the timer has not expired the control circuit repeats step 245 until such time the smart button is actuated or the timer is expired. Once either of these events occurs then the process continues to step 246 and the sensor is enabled. Next, at step 247, an estimated number of cycles is calculated based upon the dose cycle selected at step 228 and the dispenser size selected at step 232. It will be appreciated that the dispenser is shipped with default settings for one cycle and 1.25 milliliter output. It will further be appreciated that if the settings are changed at any time that the amount of usage needed to deplete the container is updated accordingly. Also at this time at step 248 the refill indicator is reset so as to not be illuminated and then at step 249 the control circuit continuously monitors the usage and illuminates the refill indicator at the time of five percent remaining material based upon the calculated usage. Of course, other alert signals could be incorporated so as to make final warnings at one percent usage remaining or at other appropriate values. Use of the timer ensures that the device is enabled in the event that the installer forgets to press the smart button after replacement of the refill container. Or if the installer does not complete the replacement steps or in the event the smart button is accidentally actuated without entering the program mode or the refill replacement mode.

Figure 14:
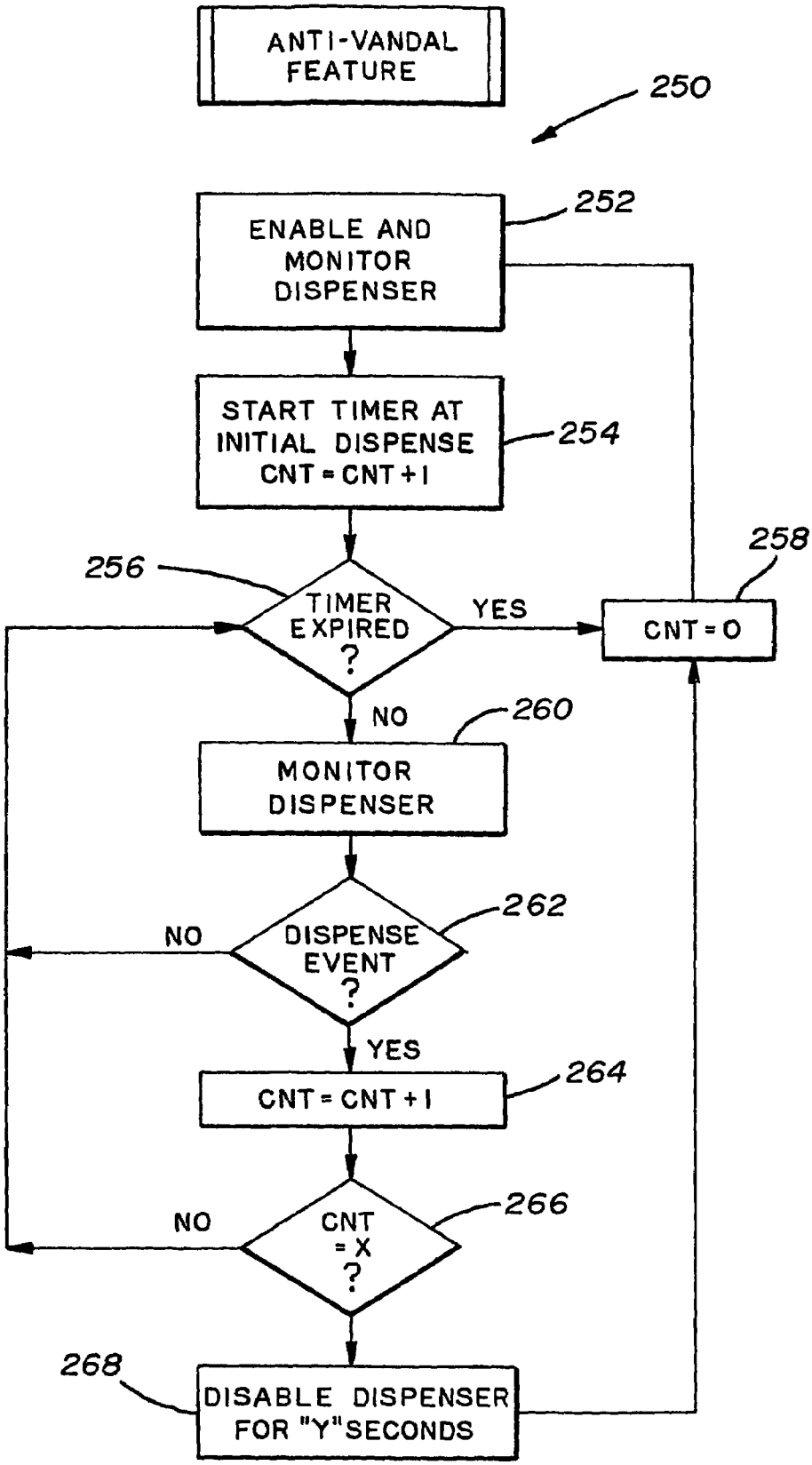
FIG. 14 is an operational flow chart for executing an anti-vandal feature of the apparatus.

Referring now to FIG. 14 it can be seen that an anti-vandal procedure of the dispenser is designated generally by the numeral 250. Briefly, the anti-vandal feature prevents excessive use in a short period of time by shutting down the dispenser. Initially, at step 252 the dispenser is enabled and the controller provides periodic monitoring. At step 254, the control circuit starts a timer at an initial dispense cycle and sets a counter equal to one. At step 256 the control circuit determines as to whether the timer has expired or not. If the timer has expired then the count is returned to zero at step 258 and the process returns to the monitoring step 252. If, however, at step 256 the timer has not expired the dispenser is again monitored at step 260. At step 262, the process inquires as to whether there has been another dispense event. If not, the process proceeds to step 256 to determine if the timer has expired yet or not. If, however, at step 262 it is determined that a dispense event has occurred then the count is increased by one at step 264. Following this, at step 266, the controller checks the count to determine whether a predetermined number of cycles have been executed. In the preferred embodiment, this number of cycles is five within the predetermined period of time, although a different value could be used. If the count is not equal to that predetermined number at step 266, then the process returns to step 256 to check on the status of the timer. If, however, at step 266 it is determined that the count is equal to the predetermined number of counts, then the dispenser, at step 268, is disabled for a predetermined period of time, preferably 45 seconds, although other time periods could be used. Upon completion of step 268 the processor returns to step 258 and the count is reset to zero and then to step 252 to enable operation of the dispenser. It will be appreciated that in certain environments dispensers are depleted of their fluids by unscrupulous individuals and this feature prevents that from happening.

Figure 15:
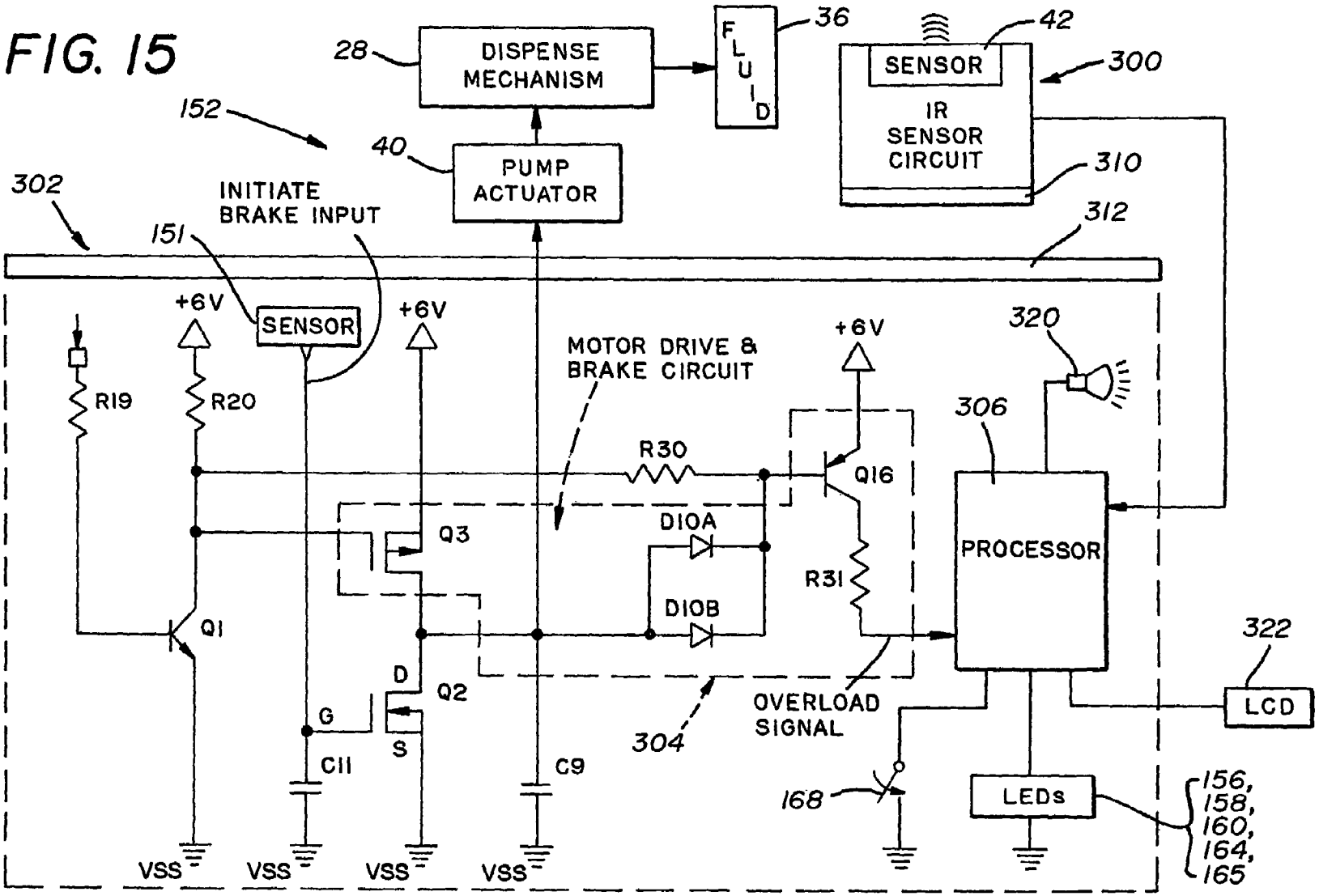
FIG. 15 is a schematic diagram of the control circuit employed by the apparatus of the present invention.

Referring now to FIG. 15, it can be seen that the control circuit utilized for implementing the aforementioned procedures is generally indicated by the numeral 152. The control circuit 152 includes a sensor circuit designated generally by the numeral 300 and a systems circuit designated generally by the numeral 302. The sensor circuit 300 includes primarily just the infrared sensor 42 for reasons which will become apparent as the description proceeds.

The system circuit 302 includes the smart/hidden switch 168, the light emitting diodes 156-165, an overload circuit 304 and a processor 306. Those skilled in the art will appreciate that the processor 306 includes the necessary timers, hardware, software and memory required to implement the aforementioned programming procedures and generally operate the components associated with the dispenser 10. Both the sensor circuit 300 and the overload circuit 304 include a respective backplane shield 310 and backplane shield 312 as indicated so as to isolate any radio frequency signals that may inadvertently activate the infrared sensor 42. In other words, it has been determined that the dispenser operates much more efficiently by separating out the circuit components associated with the sensor 42 from the other components associated with the control circuit 152. Although the sensor circuit 300 still communicates with the processor 306 for operational implementation it is isolated as much as possible to preclude interference from the system circuit 302 that may adversely trigger actuation of the sensor and thus cause an unwanted dispensing event. An audio device 320 and a liquid crystal display (LCD) 322 or other equivalent display may also be connected to the processor 306 for the purpose of displaying or announcing information related to the programming and operational status of the apparatus.

The system circuit 302 includes an overload circuit 304 which requires a logic level pulse to start the operation of the motor contained within the pump actuator 40. When the motor is running, diodes D10A and D10B measure the voltage drop across the driving MOSFET Q3. If the voltage drop exceeds a predetermined value such as 0.5 volt, an overload signal is generated by turning transistor Q16 on. In the present instance, the overload signal is operatively received by the processor 306. Once the processor 306 detects the overload signal, the processor generates a signal to turn the pump actuator 40 and thus the dispense mechanism 28 off and alerts the end-user by flashing a red light emitting diode selected from one of the LEDs 156-165. Accordingly, the overload circuit functions to detect jamming or other problems associated with the pump actuator or dispense mechanism and provides for indicating such problems to the processor which relays a system problem to the end-user. Accordingly, fluid is not dispensed and problems associated therewith are averted.

Yet another feature of the control circuit 152 is the utilization of a brake circuit which quickly stops the rotation of the electric motor shaft provided by the pump actuator 40. It will be appreciated that upon normal actuation of the motor it cycles through an operation and although an enabling signal is withdrawn from the motor, the motor shaft may continue to rotate a minimal amount. Over a period of time these additional movements of the motor shaft may cause gears within the pump actuator 40 to jam and cause related problems. Additionally, these over rotations may increase the number of dispense cycles and result in a miscalculation of the number of dispensing cycles which in turn causes the low level indicator to activate prematurely. Alternatively, output from the sensor 151, which is preferably an opto-isolator may be used to initiate brake input. In any event, the brake circuit is intended to quickly stop and prevent the over-rotation of the electric motor shaft. In order to initiate the braking process a logic level pulse on the brake input line associated with the ground of MOSFET Q2 is utilized. When this input is received, the MOSFET Q2 is activated initiating the brake by connecting the motor drive and brake output terminal to ground, effectively braking the motor to a stop. Accordingly, upon receipt of the braking signal the motor is positively stopped at a precise location so as to preclude jamming or other problems associated with over-rotation of the motor shaft.

It is apparent then from the above description of the structure and operation of the dispenser 10 that the problems and shortcomings associated with previous dispensing mechanisms have been overcome. In particular, the dispenser 10 now provides a device which provides programming features that facilitate the dispensing of different types of fluids and allows for different dosage of fluids to be dispensed. Additionally, the control circuit 152 has been improved to preclude unwanted activations of the dispensing device. Further misactivations are prevented by isolating the infrared sensor from most all other circuitry associated with the device. The device is also provided with an anti-vandal feature that prevents an excessive number of uses in a short period of time. An auto-on feature is also provided to turn the device on if it is accidentally turned-off. Additionally, the present invention provides for an installation procedure which indicates to the installer a preferred location of the dispensing mechanism so as to preclude inadvertent dispensing events. Circuitry improvements are also disclosed which facilitate the effective operation of the dispensing mechanism.

While a full and complete description of the invention has been set forth in accordance with the dictates of the Patent Statutes, it should be understood that modifications can be resorted to without departing from the spirit hereof or the scope of the appended claims.

For example, the invention has been described in the context of a dispensing mechanism for cleaning hands. However, it is apparent that the structure and operational methods of the apparatus could easily be adapted for dispensing any type of fluid material that is initiated or cycled by actuation of a touchless sensor.

What is claimed is:

1. A method for installing an automated fluid dispenser, comprising:

a) providing a fluid dispenser, an apparatus position indicator carried by said fluid dispenser, and an object sensor carried by said fluid dispenser;

b) connecting a power source to at least said apparatus position indicator and said object sensor;

c) positioning said fluid dispenser in at least one prospective mounting location;

d) emitting from said object sensor a test signal to ensure proper positioning of said fluid dispenser; and e) if necessary, repeating steps c) and d) until said apparatus position indicator provides an indication that the prospective mounting location is a proper mounting location.

2. The method according to claim 1, further comprising:

marking a position of said fluid dispenser's proper mounting location; and permanently installing said fluid dispenser at said position.

3. The method according to claim 1, further comprising:

installing a container in said fluid dispenser.

4. Apparatus for dispensing a measured quantity of fluid, comprising:

a) an object sensor;

b) a container carrying a supply of fluid;

c) a dispense mechanism coupled to said container to control an amount of the fluid to be dispensed;

d) a pump actuator mechanism coupled to said object sensor, wherein detection of an object by said object sensor cycles said pump actuator mechanism to engage said dispense mechanism which dispenses a measured quantity of the fluid;

e) a processor coupled to said object sensor and said pump actuator to control at least one operating feature maintained thereby; and f) a hidden switch carried by the apparatus, wherein actuation of said hidden switch places said processor in an operational feature mode that enables modification of said at least one operating feature.

5. The apparatus accordingly to claim 4, further comprising:

at least one illuminating indicia connected to said processor wherein entry into said operational feature mode is indicated by said at least one illuminating indicia.

6. The apparatus according to claim 5, further comprising:

at least two lights, wherein said lights are sequentially illuminated to indicate where an object should be placed for receipt of the fluid; and wherein entry into said operational feature mode allows enablement or disablement of said at least two lights.

7. The apparatus according to claim 4, wherein entry into said operational feature mode allows selection of a number of cycles of said pump actuator mechanism to control an amount of dispensed fluid upon detection of an object.

8. The apparatus according to claim 4, wherein entry into said operational feature mode allows selection of a size of said dispense mechanism.

9. The apparatus according to claim 4, further comprising:

a low level indicator connected to said processor, wherein entry into said operational feature mode allows selection of a number of cycles of said pump actuator mechanism to control an amount of dispensed fluid upon detection of an object, wherein entry into said operational feature allows selection of a size of said dispense mechanism, and wherein said processor calculates when the fluid in a given size of container will be depleted to a predetermined level based upon said number of cycles and size of said dispense mechanism.

10. The apparatus according to claim 4, further comprising:

a timer connected to said processor, said timer initiated upon actuation of said hidden switch to allow for servicing of the apparatus.

11. The apparatus according to claim 10, wherein said object sensor is disabled while said timer is running.

12. The apparatus according to claim 11, wherein said object sensor is re-enabled upon either expiration of said timer or re-actuation of said hidden switch.

13. The apparatus according to claim 4, wherein entry into said operational feature mode allows a modification associated with a type of the fluid in said container.

14. Apparatus for dispensing a measured quantity of fluid, comprising:

a) a container carrying a supply of fluid;

b) a dispense mechanism coupled to said container to control an amount of the fluid to be dispensed;

c) a pump actuator mechanism coupled to an object sensor, wherein detection of an object by said object sensor cycles said pump actuator mechanism to engage said dispense mechanism which dispenses a measured quantity of the fluid; and d) a timer associated with said dispense mechanism, said timer being utilized to disable said dispense mechanism to mitigate excessive dispensing of the fluid.

15. The apparatus according to claim 14, wherein the dispense mechanism is disabled after a predetermined time period if a predetermined number of dispense events occur within said predetermined period of time.

16. The apparatus according to claim 15, wherein said dispense mechanism is re-enabled upon completion of a second period of time.

17. The apparatus according to claim 15, wherein said predetermined period of time is about 15 seconds.

18. The apparatus according to claim 16, wherein said second period of time is about 45 seconds.

19. Apparatus for dispensing a measured quantity of fluid, comprising:

an object sensor which generates an object signal upon detection of an object;

a container carrying a supply of fluid;

a dispense mechanism coupled to said container to control an amount of the fluid to be dispensed;

a pump actuator mechanism, wherein detection of an object by said object sensor cycles said pump actuator mechanism to engage said dispense mechanism which dispenses a measured quantity of the fluid and wherein said pump actuator mechanism converts rotational motion to linear motion to cycle said dispense mechanism;

a control circuit having a processor to receive said object signal, wherein said processor generates a cycle signal received by said pump actuator mechanism to actuate said dispense mechanism;

said pump actuator mechanism having a motor for cycling said pump actuator mechanism, said motor having a drive input; and a position sensor coupled to said pump actuator mechanism to detect an end of dispense cycle, and generate a brake input signal when said end of dispense cycle is detected;

wherein generation of said brake input signal connects said motor drive input signal to ground to effectively brake said pump actuator mechanism.

20. Apparatus for dispensing a measured quantity of fluid, comprising:

an object sensor which generates an object signal upon detection of an object;

a container carrying a supply of fluid;

a dispense mechanism coupled to said container to control an amount of the fluid to be dispensed;

a pump actuator mechanism, wherein detection of an object by said object sensor cycles said pump actuator mechanism to engage said dispense mechanism which dispenses a measured quantity of the fluid and wherein said pump actuator mechanism converts rotational motion to linear motion to cycle said dispense mechanism;

a control circuit having a processor to receive said object signal, wherein said processor generates a cycle signal received by said pump actuator mechanism to actuate said dispense mechanism, wherein said cycle signal is used to drive a motor and said pump actuator mechanism; and an overload circuit carried by said control circuit, wherein if said overload circuit detects a voltage value in excess of a predetermined threshold, an overload signal is generated and received by said processor which in turn stops generation of said motor drive signal.

21. Apparatus for dispensing a measured quantity of fluid, comprising:

an object sensor which generates an object signal upon detection of an object;

a container carrying a supply of fluid;

a dispense mechanism coupled to said container to control an amount of the fluid to be dispensed;

a pump actuator mechanism, wherein detection of an object by said object sensor cycles said pump actuator mechanism to engage said dispense mechanism which dispenses a measured quantity of the fluid and wherein said pump actuator mechanism converts rotational motion to linear motion to cycle said dispense mechanism; and a control circuit having a processor to receive said object signal, said control circuit comprising a sensor circuit for said object sensor, and a systems circuit for said processor, wherein said sensor circuit and said systems circuit are maintained on their own respective circuit boards to minimize interference therebetween, and wherein said processor generates a cycle signal received by said pump actuator mechanism to actuate said dispense mechanism.

22. The apparatus according to said claim 21, wherein each said respective circuit board functions as a shielded backplane.

23. An apparatus for dispensing a measured quantity of fluid comprising:

a housing adapted to carry a container that carries a supply of fluid;

a dispense mechanism adapted to be coupled to the container to control an amount of the fluid to be dispensed;

an object sensor carried by said housing;

a pump actuator mechanism coupled to said object sensor, wherein detection of an object by said object sensor cycles said pump actuator mechanism to engage said dispense mechanism which dispenses a measured quantity of the fluid, wherein said pump actuator mechanism shuts down if said object sensor detects excessive use.

24. The apparatus according to claim 23, further comprising:

a dispense timer having a dispense time period; and a disable timer having a disable time period, wherein both said dispense timer and said disable timer are associated with said pump actuator mechanism such that during said dispense time period if a predetermined number of dispense events are detected, said pump actuator mechanism is disabled for said disable time period.

* * * * *